US007416467B2

(12) United States Patent
Avdellas

(10) Patent No.: US 7,416,467 B2
(45) Date of Patent: Aug. 26, 2008

(54) NOVELTY GIFT PACKAGE ORNAMENT

(76) Inventor: Douglas Avdellas, 1018 Sandy Lakes Cir., Palm Beach Gardens, FL (US) 33418

( * ) Notice: Subject to any disclaimer, the term of this patent is extended or adjusted under 35 U.S.C. 154(b) by 407 days.

(21) Appl. No.: 11/296,126

(22) Filed: Dec. 7, 2005

(65) Prior Publication Data

US 2006/0128262 A1 Jun. 15, 2006

Related U.S. Application Data

(60) Provisional application No. 60/634,939, filed on Dec. 10, 2004.

(51) Int. Cl.
*A63H 3/28* (2006.01)

(52) U.S. Cl. ..... 446/297; 40/124.3; 40/717

(58) Field of Classification Search ..... 40/124.3, 40/717; 446/297
See application file for complete search history.

(56) References Cited

U.S. PATENT DOCUMENTS 5,063,698 A 11/1991 Johnson et al.
5,279,514 A 1/1994 Lacombe et al.
5,500,636 A 3/1996 Mitchell
5,569,868 A * 10/1996 Leung ..... 84/600
5,738,561 A 4/1998 Pracas
5,864,288 A 1/1999 Hogan
5,973,250 A 10/1999 Zirille et al.
5,980,062 A * 11/1999 Bell ..... 362/184
6,112,442 A 9/2000 Liang
6,200,216 B1 3/2001 Peppel
6,305,547 B1 10/2001 Curran
6,568,828 B2 5/2003 Rudoy
2002/0136004 A1 * 9/2002 Rudoy ..... 362/154
2006/0042135 A1 * 3/2006 Hermanson et al. ..... 40/124.03

* cited by examiner

*Primary Examiner*—Ronald Laneau
*Assistant Examiner*—Tramar Harper
(74) *Attorney, Agent, or Firm*—McHale & Slavin, P.A.

(57) ABSTRACT

A novelty bow or ornament that is securable to a conventional gift package. The bow or ornament includes a concealed sound generator module having a battery, a tilt sensor, a data storage means, and a playback means which drives a speaker to emit prerecorded life-like sounds whenever the device is tilted more than 30° from its normally level position. Sounds may include a breaking glass, cat screaming, a dog barking, a car starting and peeling out, or the like. A power switch provides a means to extend battery life.

10 Claims, 4 Drawing Sheets

NOVELTY GIFT PACKAGE ORNAMENT

CROSS-REFERENCE TO RELATED APPLICATIONS

This application claims the benefit of the filing date of U.S. Provisional Patent Application No. 60/634,939, filed Dec. 10, 2004, the contents of which is herein incorporated by reference.

FIELD OF THE INVENTION

This invention relates generally to the field of decorative packaging, and more particularly to a motion-activated gift package ornament, illustrated as a gift bow, which enhances the novelty and thus attractiveness of a gift package.

BACKGROUND OF THE INVENTION

On festive occasions such as birthdays, parties, holidays, and the like, it is a tradition that gifts are exchanged or presented to celebrate the event. The gift is typically concealed by the use of a package having wrapping paper for decoration.

The wrapping of a gift provides an element of surprise to the person since the contents of the packaged gift are not known until the wrapping paper is removed. Items that draw attention to the package further enhance the level of anticipation to the recipient. The use of brightly-colored paper, bows and ribbons are commonly used to draw attention to the package as well as add a festive and attractive appearance.

Packaging adds a level of anticipation by heightening the curiosity of the gift receiver including all those who may see the gift wrapped package. For this reason, novelty items that further draw attention to the gift package add to the visual appeal and hence the enjoyment of receiving and opening the package.

No prior device is known to exist that provides a festive and merry ornament to the gift package that makes sounds upon movement of the bow. Such a novelty device would add to the visual attractiveness of the wrapped gift and add an audio portion to the gift which could exhibit a number of different sounds befitting humorous and or otherwise appropriate sounds that may lend themselves to the occasions where gifts are given or exchanged.

Such a gift-package ornament should be self-contained and be able engage other parts of a wrapped gift, such as ribbons or the like, to add visual interest and attraction to the wrapped gift.

DESCRIPTION OF THE PRIOR ART

Novelty items which include sound-emitting devices are known in the art. Examples include U.S. Pat. No. 5,063,698 for a greeting card with electronic sounds, U.S. Pat. No. 6,305,547 for a lunch box having an audio system, U.S. Pat. No. 5,864,288 for a talking toothbrush holder, U.S. Pat. No. 5,500,636 for talking luggage, U.S. Pat. No. 5,738,561 for a talking doll, U.S. Pat. No. 5,279,514 for a gift with personalized audio message, U.S. Pat. No. 5,973,250 for a miniature multiple audio highlight playback device, U.S. Pat. No. 6,112,442 for structure of a gift box, U.S. Pat. No. 6,200,216 for an electronic trading card, and U.S. Pat. No. 6,568,828 for illuminating packaging material. The prior art does not disclose or suggest a novelty gift package bow or ornament which includes a tilt sensor to trigger sound playback.

SUMMARY OF THE INVENTION

The present invention is a novelty ornament that emits preprogrammed sounds when the ornament has been moved from a normally level position. Thus, an objective of the instant invention is to provide a novelty item that can be attached to a gift package wherein movement of the gift package results in sound emission.

Another objective of the invention is to provide a reusable bow or ornament for gift packaging wherein the sound emitted may be altered to meet the occasion.

Still another objective of the invention is to provide a sound emitting device that will draw attention to the gift package upon movement.

Yet another objective of the invention is to provide a novelty bow or ornament with a sound device which allows a user to select from any number of prerecorded sound effects stored on the device.

In accordance with the above objectives, a novelty gift package bow comprises a ornament adapted for adhesion to a gift package, and a sound generator module disposed within the ornament so as to be concealed from view when the ornament is adhered to a gift package. The sound generator module includes an energizing means such as a battery, a data storage means for storing at least one sound signal having a defined runtime duration, a playback means for enabling the playback of the at least one sound signal, a speaker means for audibly producing the at least one sound signal, and a tilt sensor operable to sense the degree of tilt of the base with respect to the horizontal and emit a digital trigger signal when the base is tilted from a normally level position wherein the signal activates the playback means to emit the sound signal for the duration of the runtime. The digital trigger is reset when the base is returned to a horizontal position. A plurality of sound recordings can be stored in the data storage means each having a defined runtime, and the sound generator module can further comprises a switch means operable to select one of the plurality of sound recordings for playback. The switch means can comprise a manually operated switch. In a preferred embodiment, the playback means is activated when the tilt sensor detects the base is tilted at least 30 degrees from the horizontal. In a preferred embodiment, the ornament is a length of ribbon material formed into a conventional bow configuration.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
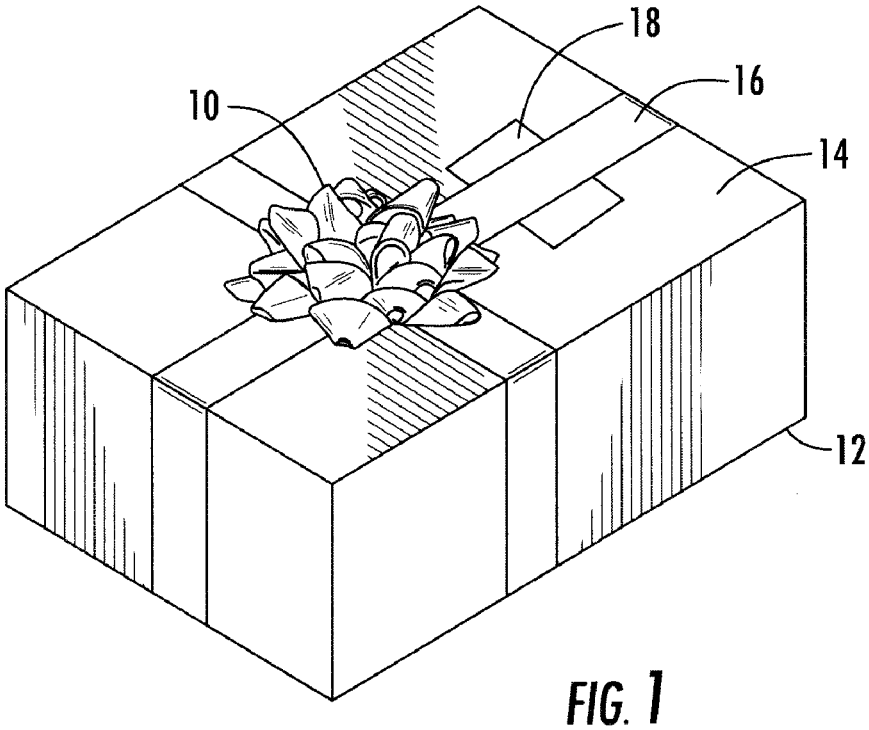
FIG. 1 is a pictorial view of the novelty gift package bow according to a preferred embodiment of the invention mounted on a gift package.

Referring to the figures, the instant invention is a novelty gift package ornament, illustrated by, albeit not limited to, a decorative bow 10 that is securable to a conventional gift package 12 (FIG. 1), which may typically include decorative wrappings 14, ribbon 16 and an announcement card 18. The novelty gift package bow 10 can have a conventional ribbon construction as shown in the figure, however the invention is not limited in this regard. In other embodiments, the bow 10 can be any type of ornament sized and configured to be affixed to a gift package for purposes of enhancing its aesthetic appeal. In the illustrated embodiment, the bow 10 is fashioned from a length of ribbon material 20 formed into a conventional bow configuration having a substantially flat base 13 adapted for adhesion to the gift package 12, as seen in FIG. 2.

Figure 2:
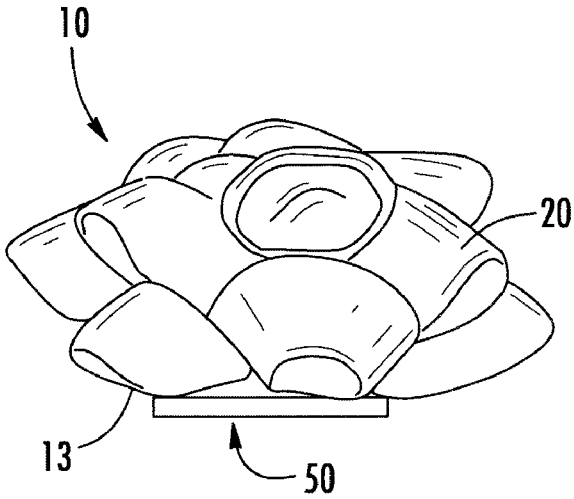
FIG. 2 is a side view of the novelty gift package bow of the invention.
Figure 3:
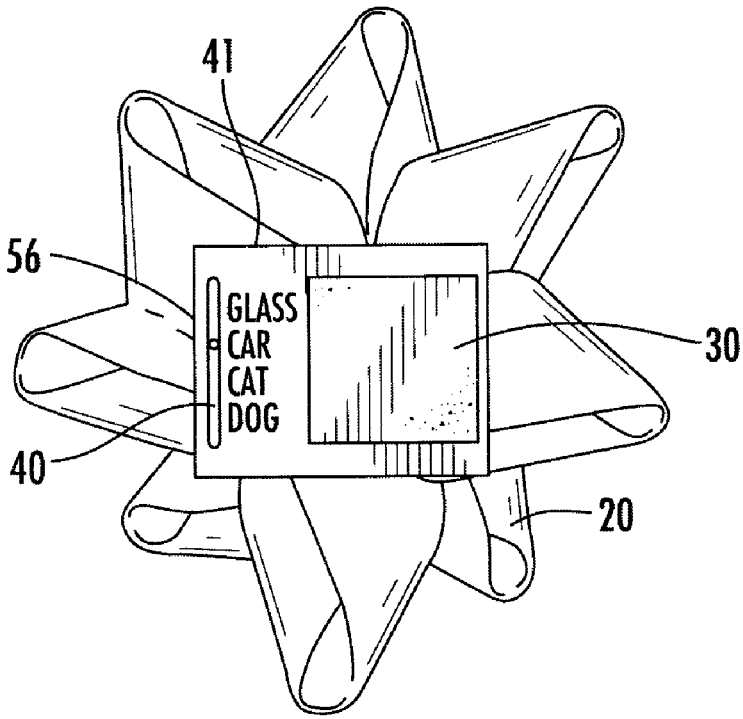
FIG. 3 is a bottom view of the novelty gift package bow showing the manual sound effect selector.

FIG. 2 illustrates an embodiment in which the sound generator module 50 is positioned directly under the bow 10 so it is not visible when attached to a package. In the illustrated embodiment, the bow 10 can be formed from any desired material nylon, cloth, silk, plastics, and so forth wherein the improvement comprises the concealment of a sound generator module 50 within the bow 10. In other embodiments, the bow 10 can be a decorative object for securement to a gift wrapped package which does not have the form of a conventional ribbon bow (e.g. an ornament formed as a snow man or wedding bells). The sound generator module 50 is triggered to play a sound whenever it is tilted from a level position. As can be seen in FIG. 3, the bow 10 can include conventional adhesive region 30 covered with a removable paper portion to permit ready attachment of the bow 10 to a surface.

Figure 4:
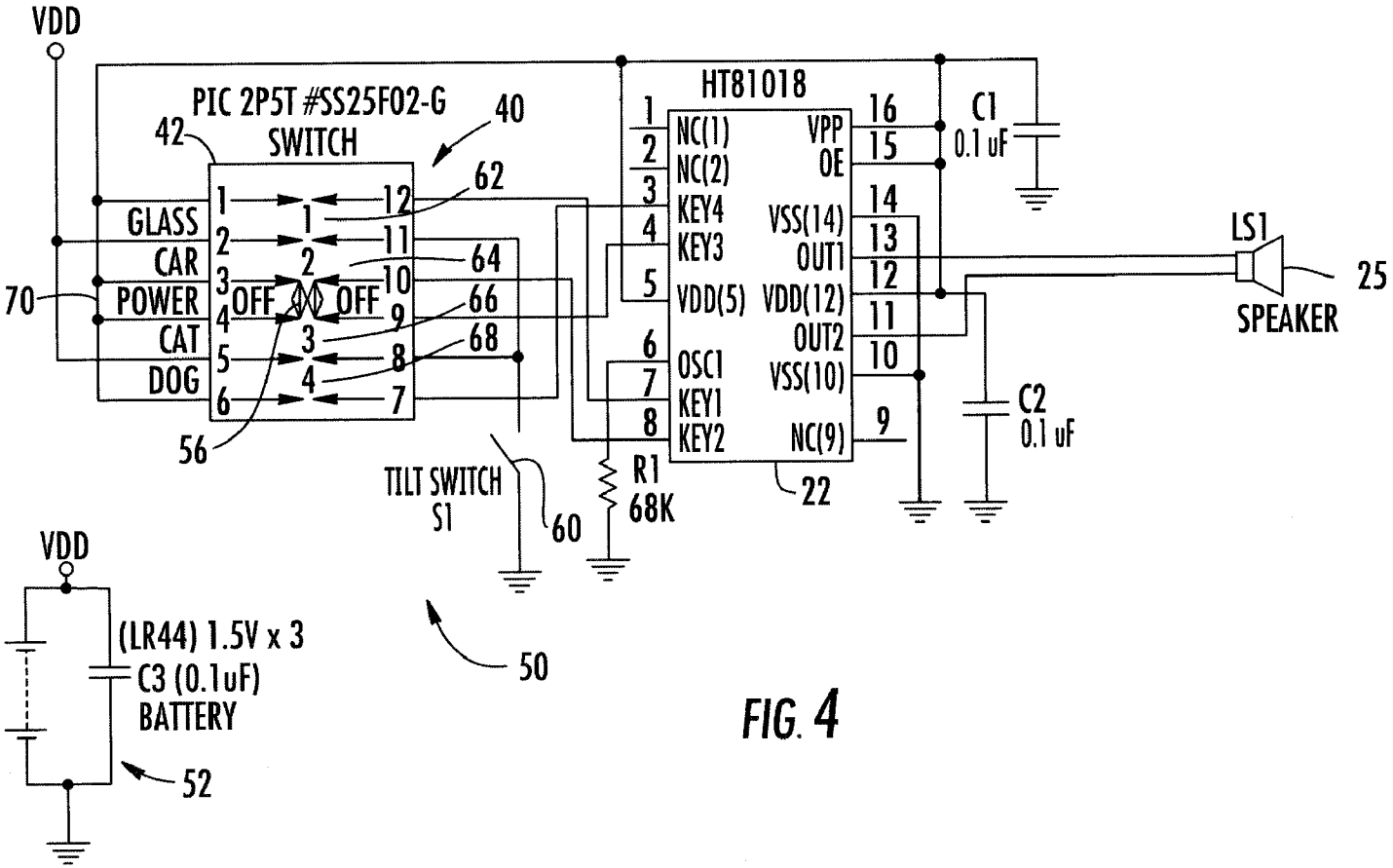
FIG. 4 is an electrical schematic of the novelty gift package bow illustrated in FIG. 3, which uses a slide selector switch.
Figure 5:
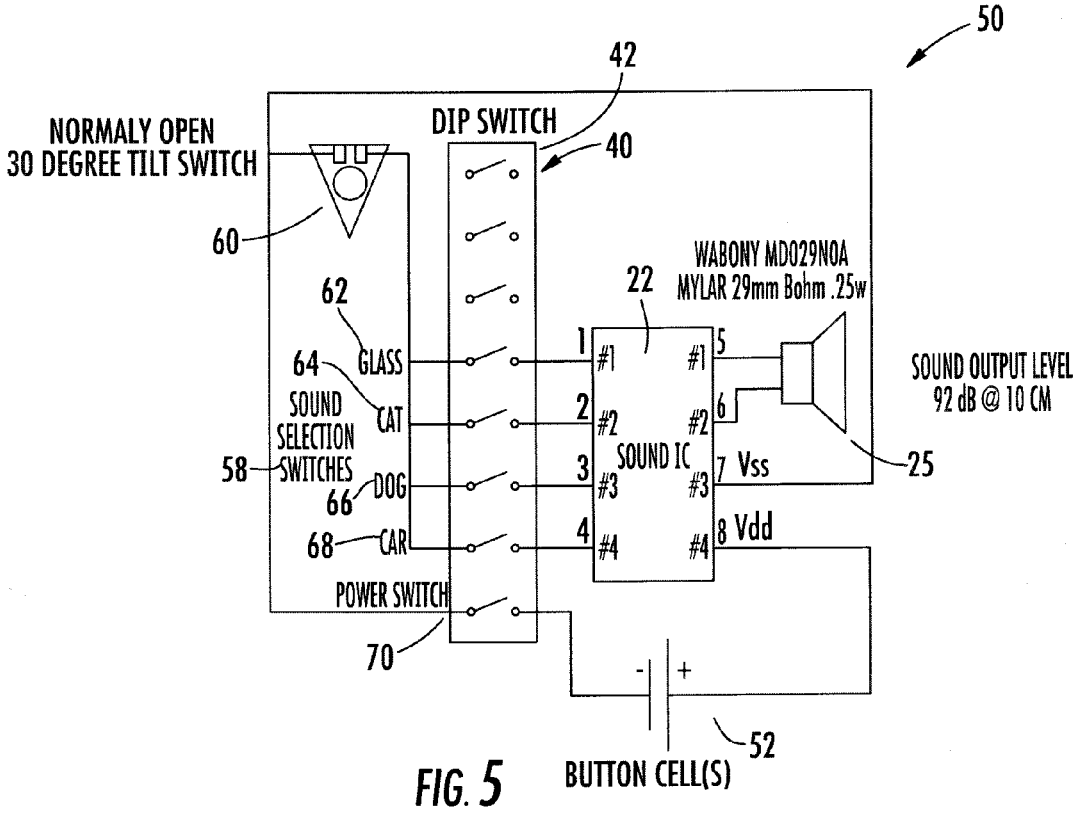
FIG. 5 is another electrical schematic of the novelty gift package bow which uses a DIP switch.

Referring to the schematics shown in FIGS. 4 and 5, wherein like elements are numbered consistently throughout, the sound generator module 50 includes a sound IC 22 which provides a data storage means for storing sound signals for playback and a means for playback of the sound signals. The sound signals created can be selected by a user. Each sound signal preferably has a define runtime duration, for example 30 seconds. The sound generator module 50 includes a sound generating means 25, such as a speaker, for audibly producing the signal. A tilt switch 60 is operable to sense the degree of tilt of the base 13 with respect to the horizontal. The tilt switch 60 emits a digital trigger signal when the base 13 is tilted from a normally level position which activates the playback means to emit the sound signal for the duration of the runtime. The digital trigger is reset only when the base is returned to a horizontal position.

In the preferred embodiment, the playback from the sound generator module 50 is triggered to start playing whenever the base 13 is tilted by 30° from a level position in any direction normal to the board. The output of the tilt switch 60 reverts back to an open condition when the base 13 is level. Preferably, the tilt switch 60 should produce an active low digital trigger when the board is in a tilted position. The tilt switch 60 output reverts back to an open condition when the board is level, thus resetting the device. A preferred tilt switch 60 is produced by the Oncque Corporation having part number RBS050100. However, any suitable tilt sensing device which can produce a binary output can be used. In other arrangements, a tilt switch can be used to produce a low going pulse as it passes from a bi-stable state from a level position +/− a few degrees to something 30° or more. This can be performed by a ball bearing making electrical contact with wires as it rolls between level and non-level.

In the preferred embodiment, a plurality of sound recordings are stored in the sound IC 22 which each have a defined runtime duration. The sound generator module 50 includes a manually operated switch means 40 allowing a user to select one of the plurality of sound recordings for playback, see FIGS. 3 and 4. As shown by the example illustrated in FIG. 3, one can select from sounds such as a dog barking, cat screaming, car peeling out, and breaking glass by manual adjustment of the manual selector 56 on the exterior of the bow 10 which is coupled to a 2P4T (single pole, 4 throw) selector slide switch 42 (FIG. 4). However, any kind of switch is acceptable, such as DIP (FIG. 5), rotary or the like. As shown in the embodiment of FIG. 3, the exterior of the sound generator module 50 preferably includes indicia 41 which identifies the sound effect to be selected.

Any desired sound effect can be stored on the sound IC 22, albeit not limited to, baby crying, sirens, phone ringing, bomb/explosion, car crash, birds singing/chirping, scream, jungle sounds (roar), and phases, such as, "stop shaking me", "put me down", "don't drop me". Additionally, musical pieces suitable for a given occasion can be stored on the sound IC22, such as happy birthday music, wedding march music, Christmas carols, etc. Custom pre-recorded spoken messages can also be stored on the sound IC 22. In operation, a coin cell battery 52 (preferably 44.5 mm×44.5 mm) effects a PCB (printed circuit board) that drives a 29 mm diameter speaker such as a Wabondy MD029NOA Malar 8 ohm speaker 25.

In the another embodiment shown in FIG. 5, the PCB board employs a switch means 40, specifically, a multipole user DIP switch 42 selectable with life-like sounds 58 whenever the board is tilted more than 30° from its normally level position causing activation from a normally open tilt switch 60. For instance, switch 62 can be for breaking glass, switch 64 can be for a cat sound, switch 66 can be for a dog barking, and switch 68 can be for a car starting and peeling out. The DIP switch is advantageous as it may be used to trigger other recordings, play a single sound, or play a plurality of sounds. Any of the aforementioned switches can be integrated in the PC board contacts to reduce cost.

In both the embodiments of FIGS. 4 and 5, a power switch 70 provides a means for extending battery life and tilting the PCB board in any direction triggers the sound to start playing. The sound will continue to play un-interrupted until its natural end. Changing the board position while the recording is playing will not cause an interruption of the recording. The device automatically resets itself and remains quiet until the device is again tilted from the level position. The device must be returned to a level position and tilted to trigger sound playback again.

The playback sound data is compatible with 8 bit PCM (pulse code modulation) audio sampled at 11 kb/s and is capable of storing about 18 seconds of audio sounds. Audio silence exists within the sound FX data so the ability to provide silence without using sound FX sample memory is permissible.

The speaker provides a quality sound at the high SPL (sound pressure level) level, a SPL of 92 dB at 10 cm and the speaker frequency response is within 6 dB of a 1 kHz reference from 400 Hz to 10 kHz. In the preferred embodiment, at least one 250 mW plastic frame speaker having a 29 mm diameter with a self resonance around 570 Hz is mounted in the bow. The impedance chosen produces the maximum volume with acceptable distortion.

The battery 52 allows a moderate to large load support for a loud quality sound output, medium shelf life, and with enough energy to operate the device for a few hours of intermittent use. The preferred battery is an alkaline-manganese LR44 type battery wherein three 1.5V coin cells be, used in series, develop sufficient electromotive force to drive the speaker to a desired level.

The sound IC 22, as shown in FIGS. 4 and 5, is capable of generating one of a plurality of user selectable sounds. The sound device is preferably an IC such as that produced by Holtek Semi Conductor Corporation, item number HT-81R36. The device is triggered by an active low tilt switch trigger. The sounds are non-retriggerable, that is, the sound will go on playing until it naturally ends, whether or not there are any additional triggers received during the playback time.

In a preferred embodiment, the sound device directly drives the speaker with a digital PWM (pulse width modulation) output stage. It must be able to source 0 mA and sink over 100 mA to achieve the SPL required without external amplifier parts tolerating a supply voltage of at least 4.5V. For instance, the specifications of the Holtek sound generator specify the PWM speaker current capability at +110 mA/−20 mA, which when given a 4.5 volt input, implies the drive to the speaker is current limited by the sound device, not voltage limited. The power delivered to the speaker under these conditions varies by its impedance. A 20 mA current limited PWM signal driving a speaker impedance of 8 ohms will produce 3.2 mW of sound, a 16 Ohm device will produce 6.4 mW of sound, and a 32 Ohm speaker will produce 12.8 mW of sound.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A novelty gift package ornament, comprising:

an ornament sized and configured for adhesion to a gift package, about a surface disposed within a horizontal plane, for enhancing the aesthetic appeal thereof; and a sound generator module disposed within said ornament, and constructed and arranged to be concealed from view when said ornament is adhered to a gift package, said sound generator module including at least one energizing means, a data storage means constructed and arranged to store at least one sound signal having a defined runtime duration, playback means for enabling playback of said at least one sound signal, sound production means for audibly producing said at least one sound signal, tilt detection means constructed and arranged to sense a degree of tilt of the ornament with respect to said horizontal plane and operative to emit a digital trigger signal when said horizontal plane is tilted from a normally level position wherein said trigger signal activates said playback means to emit said sound signal for said defined runtime duration.

2. The novelty gift ornament of claim 1, wherein said digital trigger signal is reset when said horizontal plane is returned to a horizontal position.

3. The novelty gift ornament of claim 1, wherein a plurality of sound recordings are stored in said data storage means each having a defined runtime, and said sound generator module further comprises a switch means operable to select one of said plurality of sound recordings for playback.

4. The novelty gift ornament of claim 3, wherein said switch means includes a manual selector accessible from an exterior portion of said ornament.

5. The novelty gift ornament of claim 1, wherein said tilt detecting means is a tilt switch.

6. The novelty gift ornament of claim 1, wherein playback means is activated when said tilt detecting means detects said base is tilted at least 30 degrees from the horizontal.

7. The novelty gift ornament of claim 1, where said playback means and said data storage means are integrated into a sound IC.

8. The novelty gift ornament of claim 1, where said sound generator module further comprises a manually activated on/off switch coupled to said energizing means.

9. The novelty gift ornament of claim 1, wherein said sound generator module forms a lower surface of said ornament.

10. The novelty ornament of claim 1, wherein said ornament is a bow and is formed from ribbon material.

* * * * *